United States Patent [19]

Matsko et al.

[11] Patent Number: 4,791,889

[45] Date of Patent: Dec. 20, 1988

[54] STEAM TEMPERATURE CONTROL USING A MODIFIED SMITH PREDICTOR

[75] Inventors: Theodore N. Matsko, Chesterland; Robert S. Rand, Painesville, both of Ohio; Thomas D. Russell, Georgetown, Tex.; Thomas J. Scheib, Chesterland, Ohio; Robert R. Walker, deceased, late of Euclid, Ohio, by Dorothy H. Walker, executrix

[73] Assignee: The Babcock & Wilcoc Company, New Orleans, La.

[21] Appl. No.: 34,122

[22] Filed: Apr. 2, 1987

[51] Int. Cl.[4] ..... F22G 5/00

[52] U.S. Cl. ..... 122/479 R; 236/14

[58] Field of Search ..... 122/479 R, 479 C, 479 S, 122/460, 448 R, 448 S; 236/14

[56] References Cited

U.S. PATENT DOCUMENTS 4,241,701 12/1980 Morse ..... 122/479 R X
4,549,503 10/1985 Keyesiv et al. ..... 122/479 R

FOREIGN PATENT DOCUMENTS 5447004 4/1979 Japan ..... 122/479 R

*Primary Examiner*—Edward G. Favors
*Attorney, Agent, or Firm*—Vytas R. Matas; Robert J. Edwards

[57] ABSTRACT

A system for controlling steam temperature in a boiler using a time delay feedback controller known as a Smith Predictor to provide control tuning of true boiler parameters which change with load.

5 Claims, 5 Drawing Sheets

PRIOR ART FIG. 4

STEAM TEMPERATURE CONTROL USING A MODIFIED SMITH PREDICTOR

BACKGROUND OF THE INVENTION (1) Field of the Invention

The present invention relates to steam temperature control systems in general and in particular to such systems which control tuned parameters which change in response to system load.

(2) Description of the Prior Art

Steam temperature control on a drum type boiler is difficult due to time lags and delays built into the design of the process. There are time delays between the attemperator spray location and its effect on final steam temperature leaving the secondary superheater. Time lags are also caused by the head transfer characteristics of the superheater metal and the steam itself.

Any control with relatively long time constants (two minutes or longer) will operate in a more stable fashion if open loop predictive (feedforward) methods are employed to preset the controlled medium. In addition, if intermediate control points are useful and somewhat predictive of the final steam temperature, then these are also useful in a cascade method of control.

Almost all drum type boilers are designed to have a generally rising uncontrolled secondary superheater outlet temperature profile with increasing boiler load. The design usually is such that the unit does not have to reach the required main steam outlet temperature at loads below 50 percent boiler load, and therefore is not controlled at these loads. Above such a load, the excess superheat temperature is "sprayed out" by the spray attemperator.

Classical control techniques commonly used in steam temperature controls are feedforward, feedback using proportional plus integral plus derivative controller, cascade, and anti-integral windup.

Because of the time delay and time lag, a standard proportional plus integral controller will either be detuned, providing a slow, sluggish control, or be unstable.

As the response time characteristics will vary with load, the control adjustments are usually set as a compromise between high and low load settings.

To prevent the controller from integrating when the spray valve is closed at low loads, controller limits are developed to prevent the P.I.D. controller from integrating upward.

Thus the classical control system does not address two vital problems; i.e. true time delay and control tuning parameters which change with load.

SUMMARY OF THE INVENTION

The present invention solves the discussed problems associated with prior art control systems as well as other by using adaptive control techniques and time delay control techniques (Smith Predictor) in steam temperature control to provide for a specialized control to accommodate long delay times and process lags. Also this control uses the dynamics of the boiler as temperature reacts to short term process excursions during load changes and deviations caused by upsets due to combustion air changes and/or sootblowing as well as changes due to reheat temperature control measures employed such as tilting burners, gas recirculation or biasing dampers. Thus, one aspect of the present invention is to adapt a time delay control known as a Smith Predictor to steam temperature control systems.

Yet another aspect of the present invention is to adapt an adaptive gain control to steam temperature control systems.

Yet another aspect of the present invention is to control superheat temperatures in applications involving the use of attemperator sprays injected into the superheating system between the primary and secondary superheater surfaces.

Still yet another aspect of the present invention is to control superheat temperatures in applications involving boilers with multiple levels of superheaters and multiple attemperation points.

These and other aspects of the present invention shall be more fully understood upon a review of the following description of the preferred embodiment when considered in conjunction with the drawings.

DESCRIPTION OF THE PREFERRED EMBODIMENT

The figures, in general, depict the preferred embodiment of the subject invention in function block diagrams which are well known in the art and described in Bailey Controls Company publication titled "Functional Diagramming of Instruments and Control Systems", which publication is hereby incorporated by reference herein. Further, adaptive gain controls are generally known in the art and described in Bailey Controls Company technical paper TP81-5 titled "Adaptive Process Control Using Function Blocks", which publication is also incprorated by reference herein.

Figure 1:
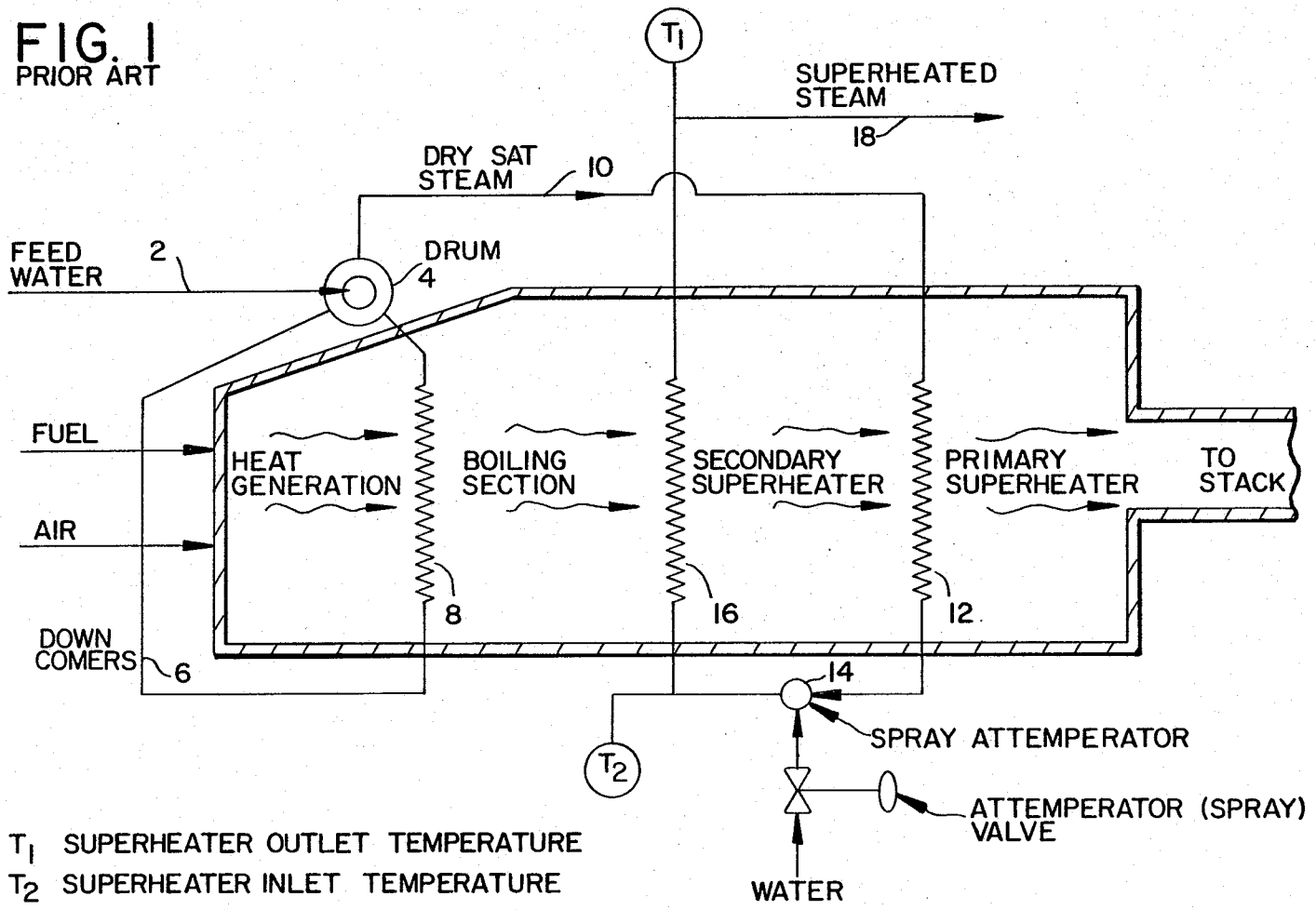
FIG. 1 PRIOR ART
FIG. 1 is a schematic of a typical boiler.

Refering now to the drawings, FIG. 1 shows a typical boiler with feedwater 2 entering a steam drum 4 passing down the downcomers 6 into the boiler section 8 where the feedwater 2 is converted into a steam and water mixture. The steam is separated from the water in the drum 4 and dry saturated steam 10 is sent to the primary superheater 12. The superheated steam from the primary superheater is cooled by the spray attemperator 14 and passes through the secondary superheater 16. The superheated steam 18 then goes to either a turbine, process or both.

There are time delays between the attemperator spray location and its effect on final steam leaving the secondary superheater. Time lags are also caused by the heat transfer characteristics of the superheater metals and the steam itself.

Figure 2:
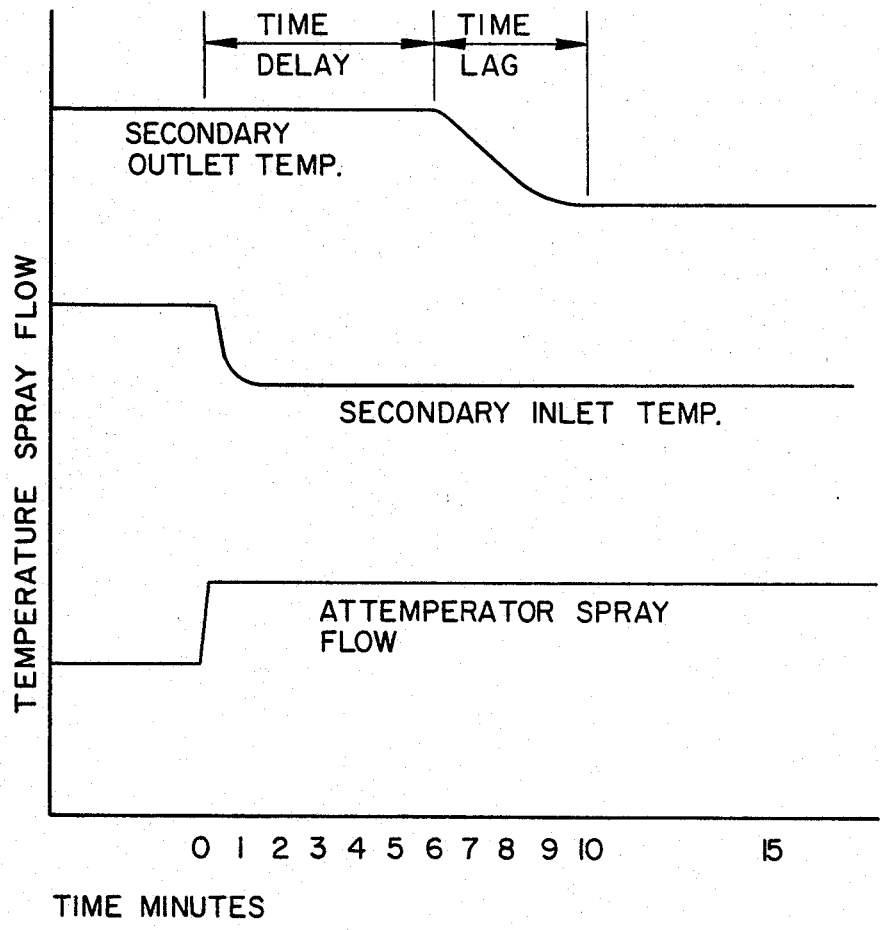
FIG. 2 is a graphic representation illustrating a typical reaction of superheat steam temperature to a change in attemperator water flow.
Figure 3:
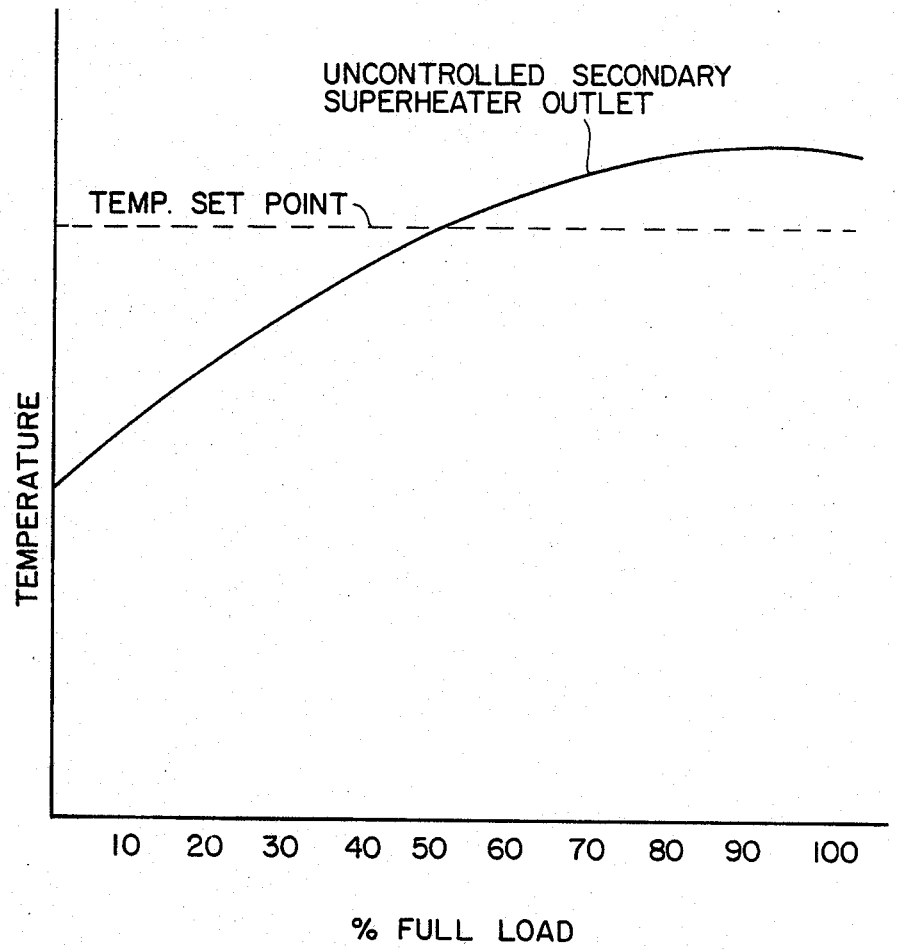
FIG. 3 is a graphic representation of uncontrolled secondary superheater outlet steam temperature versus percentage full load.

FIG. 2 illustrates a typical reaction of superheat steam temperatures to a change in attemperator water flow. The size and times will vary depending on boiler design, size and load rating, thus actual temperatures and water flows are not quantified. The time illustrated is typical of a boiler having a main stream flow of about 4,000,000 pound per hour, operating at about half load.

At full load the time response will be faster resulting in a shorter dead time and some reduction in time lag. These changes must be accounted for.

Any control with relatively long time constants (two minutes or longer) will operate in a more stable fashion if open loop predictive (feedforward) methods are employed to preset the controlled medium. In addition, if intermediate control points are useful and somewhat predictive of the final steam temperature, then these are also useful in a cascade method of control.

Almost all drum type boilers are designed to have a generally rising uncontrolled secondary superheater outlet temperature profile with increasing boiler load. The design usually is such that the unit does not have to reach the required main stream outlet temperature at loads below about 50 percent boiler load, and therefore is not controlled at these loads. Above such a load, the excess superheat temperature is "sprayed out" by the spray attemperator.

Classical control techniques commonly used in steam temperature controls are feedforward, feedback using proportional plus integral plus derivative controllers, cascade and anti-integral windup.

Figure 4:
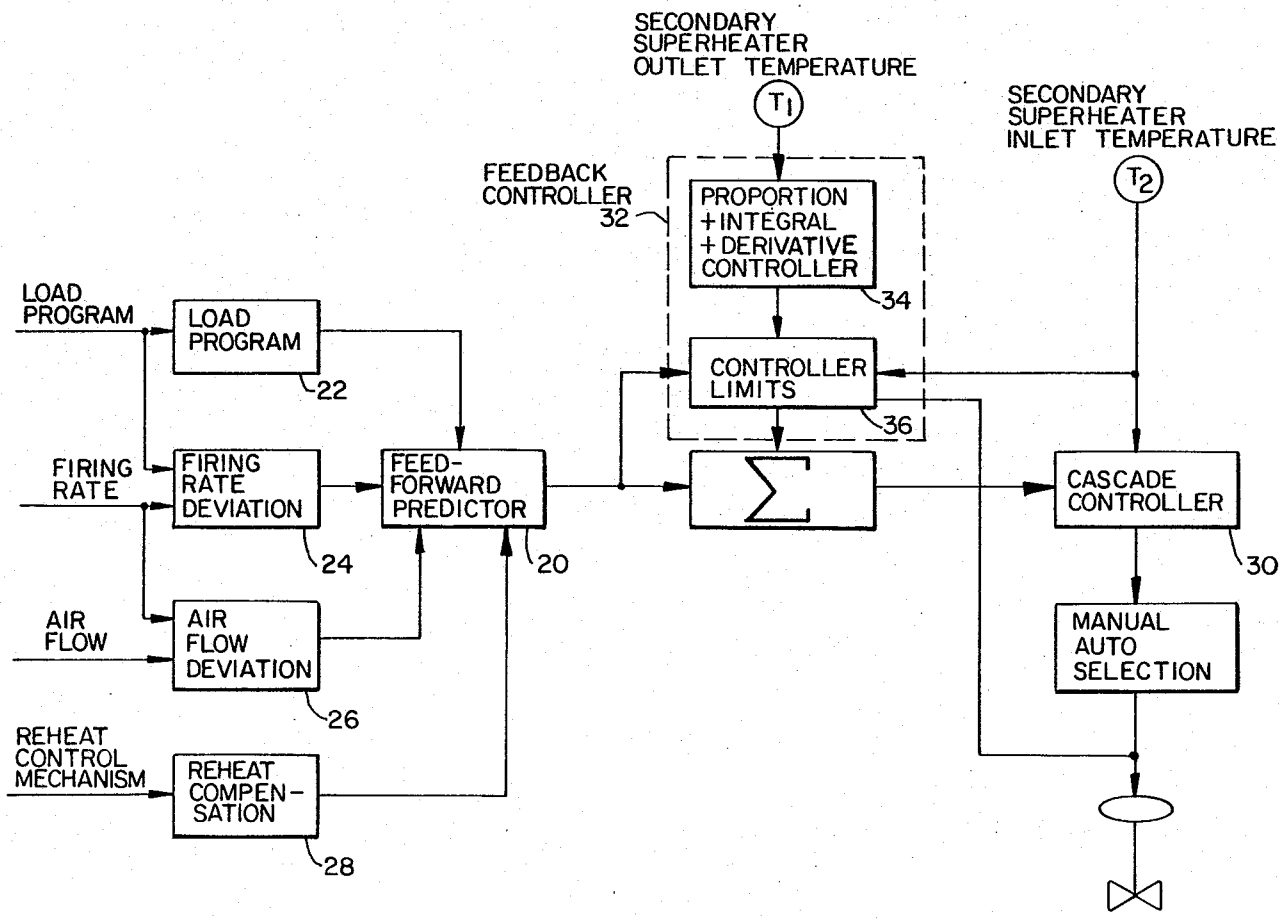
FIG. 4 is a schematic of a typical steam temperature control system.

FIG. 4 shows a prior art steam temperature control. The feedforward predictor 20 presets an expected secondary superheater inlet temperature in accordance with a predicted load program 22. This prediction is then modified by the difference 24 between the firing rate required for a given boiler load and the actual firing rate. Overfiring raises temperature and underfiring reduces temperature.

A similar modifier 26 accounts for excess air which will also cause temperature to rise as air flow is increased.

A third modifier 28 accounts for any reheat temperature control that may impact the superheat temperature.

This feedforward predictor generates the set point for the secondary superheater inlet temperature cascade controller 30.

Since no feedforward is perfect, a final trim or correction is applied from superheater outlet temperature through the feedback controller 32.

The final trim is through a conventional proportional plus integral plus derivative (P.I.D.) controller 34 which compares final steam temperature to the desired setpoint.

Figure 5:
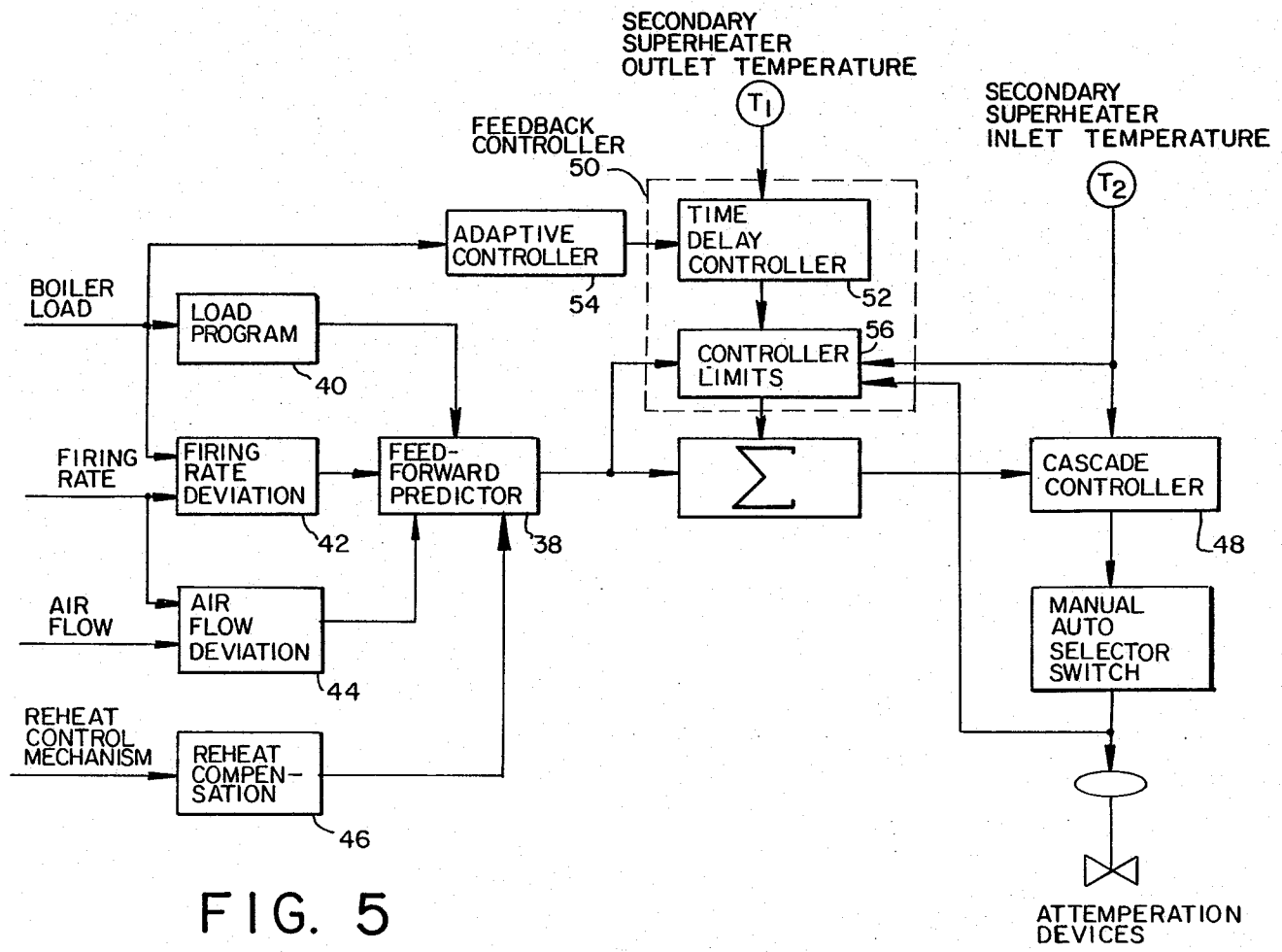
FIG. 5 is a schematic of a steam temperature control system of the present invention.

Referring now to FIG. 5, a schematic depicting a preferred embodiment of the invention is shown.

The feedforward predictor 38 presets an expected secondary superheater inlet temperature with a load 40. This prediction is modified by the difference 42 between the firing rate required for a load and the actual firing rate. Overfiring raises temperature and underfiring reduces temperature. A similar modifier 44 accounts for excess air which will also cause temperature to rise as air flow is increased. A third modifier 46 accounts for any reheat temperature control that may impact the superheat temperature.

This feedforward predictor 38 generates the set point for the secondary superheater inlet temperature cascade controller 48. As no feedforward is perfect, a final trim or correction is applied from superheater outlet temperature through the feedback controller 50. Because of time delay and time lag illustrated in FIG. 2, a standard proportional plus integral controller will either be detuned providing a slow, sluggish control or be unstable. Thus a time delay controller 52 is provided to provide improved speed of response with stable control. As the response time characteristics will vary with load the time delay controller 52 will be tuned by an adaptive controller 54.

To prevent the time delay controller 52 from integrating when the spray valve is closed at low loads, controller limits 56 are developed to prevent the time delay controller 52 from integrating upward. The time delay controller 52 incorporates a process modeling technique which consists of a time delay which is adjusted to match the time delay illustrated in FIG. 2 plus a first order time lag as illustrated in the same Figure. These two time constants are externally adjustable from load through the adaptive controller 54 to accommodate time constants that will vary with the steam production rate of the boiler.

Certain modifications and improvements have been deleted herein for the sake of conciseness and readability, but which are properly within the scope of the following claims. For example, for clarity an attemperator water spray valve(s) has been shown. The invention is, however also applicable to temperature control devices such as tilting burners, mud drum attemperators, saturated steam condensers, gas recirculation, biasing dampers and similar applications.

We claim:

1. A steam temperature controller comprising:

a feedforward predictor for presetting an expected secondary superheater inlet temperature with a boiler load and for generating a secondary superheater inlet temperature cascade controller set point;

a first modifier means for correcting said expected first temperature for the deviation between a firing rate required for the boiler load and an actual firing rate;

a second modifier means for correcting said expected inlet temperature for deviation of an air flow rate required for the firing rate for the boiler load and an actual air flow rate;

a third modifier means for correcting said expected inlet temperature for reheat temperature control;

a feedback correction control means for final correction; and a cascade control means responsive to said inlet temperature for providing rapid process loop response to predictable intermediate process control points.

2. A steam temperature controller according to claim 1, further including a spray valve, and wherein said feedback correction control means further comprises time delay control means with low load controller limits to prevent upward integration when the spray valve is closed at low loads.

3. A steam temperature controller according to claim 2 further comprising an adaptive controller to tune said time delay control means according to boiler load variations.

4. A method of controlling the temperature of steam in a boiler comprising the steps of:

presetting an expected secondary superheater inlet temperature with a boiler load;

generating a secondary superheater inlet temperature cascade controller set point;

correcting said expected inlet temperature for the deviation between a firing rate required for the boilder load and an actual firing rate;

correcting said expected inlet temperature for the deviation of an air flow rate required for the firing rate for the boiler load and an actual air flow;

correcting said expected inlet temperature for reheat temperature control;

providing final feedback correction of said inlet temperature; and providing rapid process loop response to said inlet temperature for rapid process loop response to predictable intermediate process control points.

5. The method of claim 4 further comprising the steps of:

providing feedback correction control means with time delay control means with low load controller limits to prevent upward integration when a spray valve is closed at low loads; and providing adaptive gain control for tuning said time delay control means according to boiler load variation.

* * * * *

UNITED STATES PATENT AND TRADEMARK OFFICE

CERTIFICATE OF CORRECTION

PATENT NO. : 4,791,889

DATED : Dec. 20, 1988

INVENTOR(S) : Matsko et al

It is certified that error appears in the above-identified patent and that said Letters Patent is hereby corrected as shown below:

On the cover page of the patent, under "Assignee:", kindly delete "Wilcoc" and insert therefor --Wilcox--.

Signed and Sealed this

Ninth Day of April, 1991

*Attest:*

HARRY F. MANBECK, JR.

*Attesting Officer*

*Commissioner of Patents and Trademarks*